United States Patent [19]

Hodgin et al.

[11] Patent Number: 4,858,288

[45] Date of Patent: Aug. 22, 1989

[54] METHOD VORTEX ACTION YARN HAIRINESS REDUCTION

[75] Inventors: John B. Hodgin, Pleasant Garden; John H. Sumner; Kenneth Y. Wang, both of Greensboro, all of N.C.

[73] Assignee: Burlington Industries, Inc., Greensboro, N.C.

[21] Appl. No.: 719,129

[22] Filed: Apr. 2, 1985

[51] Int. Cl.[4] ..... D02H 5/02; D02J 1/16

[52] U.S. Cl. ..... 28/178; 28/219

[58] Field of Search ..... 28/178, 219; 57/333

[56] References Cited

U.S. PATENT DOCUMENTS

| | | | |
|---|---|---|---|
| 3,155 | 7/1843 | Titt et al. . | |
| Re. 30,474 | 1/1981 | Malpass et al. | 28/178 X |
| 108,100 | 10/1870 | Brady . | |
| 112,600 | 3/1871 | Jaquith . | |
| 782,192 | 2/1905 | Fredenburgh . | |
| 1,062,806 | 5/1913 | Stohr . | |
| 1,474,560 | 11/1923 | Snyder . | |
| 2,077,283 | 4/1937 | Taylor et al. . | |
| 2,144,768 | 1/1939 | McCallum . | |
| 2,438,084 | 3/1948 | Wood . | |
| 2,515,299 | 7/1950 | Foster et al. | 57/333 |
| 2,932,076 | 4/1960 | Cocker | 28/179 X |
| 3,279,164 | 10/1966 | Breen et al. | 57/333 X |
| 3,439,491 | 4/1969 | Scruggs | 57/333 X |
| 3,448,570 | 6/1969 | Stoller | 57/333 X |
| 3,732,603 | 5/1973 | Illman et al. . | |
| 3,763,526 | 10/1973 | Benson et al. . | |
| 3,778,988 | 12/1973 | White . | |
| 3,892,018 | 7/1975 | Rose . | |
| 3,910,021 | 10/1975 | Van Petten | 57/333 X |
| 3,935,623 | 2/1976 | Mettler . | |
| 3,983,722 | 10/1976 | Lefebvre et al. . | |
| 3,990,132 | 11/1976 | Illman et al. | 28/178 |
| 4,004,406 | 1/1977 | Suzuki et al. | 57/333 X |
| 4,028,870 | 6/1977 | Kawasumi et al. . | |
| 4,138,840 | 2/1979 | Greenway et al. . | |
| 4,141,121 | 2/1979 | Trifunovic | 57/333 X |
| 4,916,241 | 4/1980 | van Anholt et al. . | |

FOREIGN PATENT DOCUMENTS 1415396 11/1975 United Kingdom .

OTHER PUBLICATIONS

*TEXTILE HORIZONS*, Jun. 1982, article by Wilson entitled "Air Jets Add Extra Virtues to Spun Yarn."

*Primary Examiner*—Robert R. Mackey
*Attorney, Agent, or Firm*—Nixon & Vanderhye

[57] ABSTRACT

Yarn hairiness is reduced by employing a vortex action of a fluid, such as air or steam. Yarn in a substantially dry condition is passed in a generally linear path through a body having a central through-extending generally linear passageway that is circular in cross-section. A plurality of bores are provided in the body which extend from the periphery of the body to intersect the central passageway, being tangentially disposed with respect to the central passageway. Fluid under pressure is introduced into the bores, and creates a vortex action which acts upon the yarn to twist and lay down protruding hairs that cause yarn hairiness. The bores are preferably disposed at an angle of about 40°-50° with respect to the central passageway, and are spaced along the length of the passageway. Shortly after the yarn exits the body, hot melt sizing is applied to it to maintain the protruding hairs in their laid down position.

12 Claims, 2 Drawing Sheets

Fig. 3
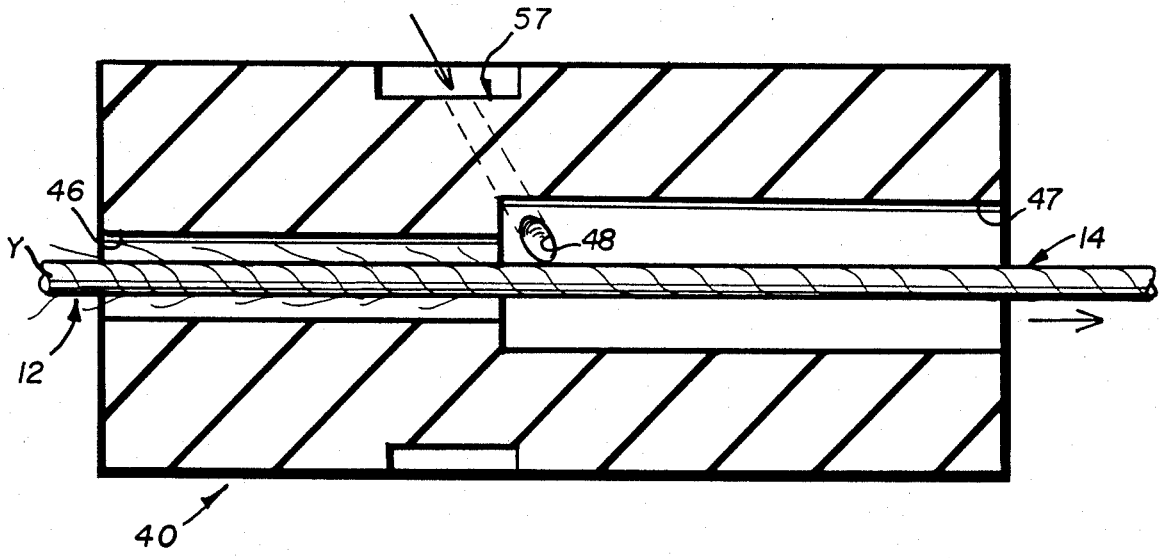
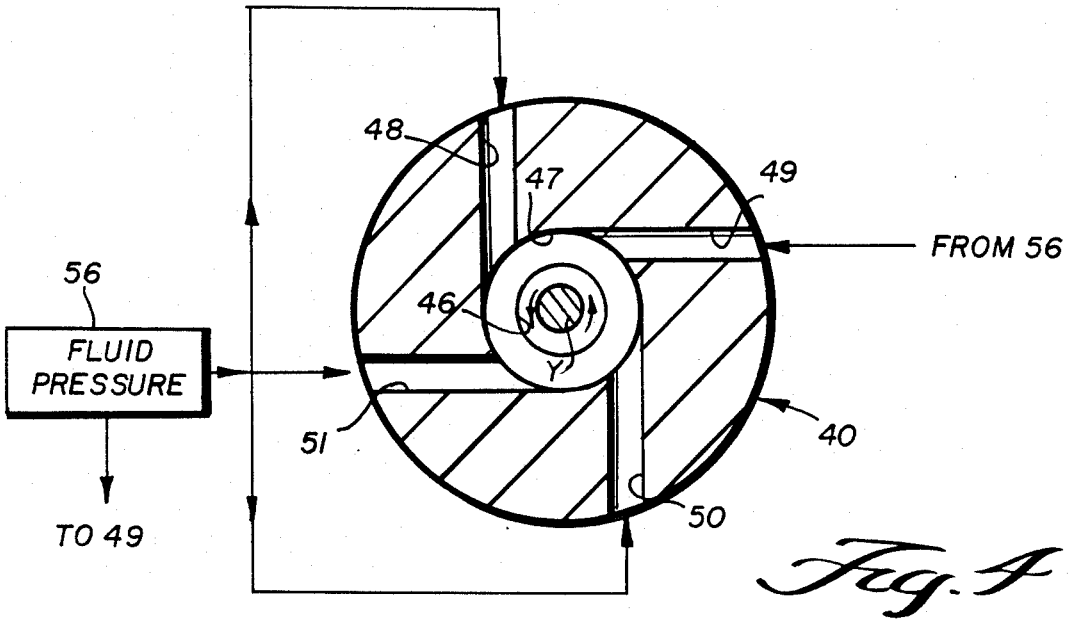
Fig. 4

METHOD VORTEX ACTION YARN HAIRINESS REDUCTION

BACKGROUND AND SUMMARY OF THE INVENTION

In conventional processes of spinning short staple fibers into yarn, a number of the fiber ends will extend outside the body of the yarn, and produce a yarn "hairiness". The amount of hairiness depends upon many factors such as the blend ratio, the quality of the synthetic and natural fibers in the yarn, the spinning process and condition of the spinning machine, etc. In most circumstances, it is desirable to minimize the yarn hairiness since it can cause operational problems in processes subsequent to the spinning operation. For instance, in slashing or other size application processes, where protective film is appied to the outside of the yarn, it is highly desirable to minimize the yarn hairiness prior to the slashing or other (e.g. hot melt) size application operations. Further, reductions in the yarn hairiness will tend to improve weaving performance, increase tensile strength of the yarn, increase pilling resistance, improve yarn appearance, improve beaming performance, and reduce the need for singeing.

According to the present invention, a method and apparatus are provided for significantly reducing yarn hairiness in a simple and effective manner. According to the present invention, yarn having undesired hairiness is subject to a vortex of fluid (such as air or steam), which causes protruding hairs of the yarn to be twisted and laid down. Practicing the invention produces yarn hairiness reductions of up to about 72%. After hairiness reduction, size is applied to the yarn immediately, such as by using available hot melt sizing apparatus, to maintain the protruding hairs in their laid-down position. Because the hairs have also been twisted, after desizing the twisted hairs remain so, and the end product produced from the yarn can then have significant advantages. The vortex jet also effectively removes short fibers, lint and trash held loosely on the yarn. The yarn is left cleaner, and deposition of lint on rolls, guide surfaces, and other machine components is greatly reduced. Similarly, other problems caused by lint such as dropped stitches, loom stops, and knitting stops are also reduced.

According to a first aspect according to the present invention, there is provided a method of treating yarn having undesired hairiness, comprising the steps of: (a) passing the yarn, in substantially dry condition, in a generally linear path; and (b) while the substantially dry yarn is passing in the generally linear path, directing a plurality of streams of fluid under pressure towards the path so as to establish a vortex action acting on the yarn which twists and lays down protruding hairs causing the undesired yarn hairiness, so that undesired yarn hairiness is substantially eliminated.

According to another aspect of the present invention, there is provided an apparatus for reducing yarn hairiness comprising: (a) A body having a substantially central through-extending linear passageway generally circular in cross-section, with a yarn inlet at a first end of the body, and a yarn outlet at the second end of the body, the body also having an outer periphery. (b) Means defining a plurality of fluid conducting bores each extending from the outer periphery of the body to the central passageway, and intersecting and tangentially disposed with respect to the central passageway, so that fluid introduced to the central passageway by the bores exhibits a vortex action acting directly upon yarn passing through the passageway where each bore intersects the passageway. And, (c) means for supplying fluid under pressure to the plurality of bores.

According to yet another aspect of the present invention, there is provided an apparatus for reducing yarn hairiness comprising: (a) A body having a substantially central through-extending linear passageway generally circular in cross-section, with a yarn inlet at a first end of the body, and a yarn outlet at the second end of the body, the body also having an outer periphery. (b) Means for defining a plurality of fluid conducting bores each extending from the outer periphery of the body to the central passageway and intersecting and tangentially disposed with respect to the central passageway; each of said bores making a positive angle with respect to the passageway of significantly greater than 0°, and significantly less than 90°. And, (c) means for supplying fluid under pressure to the plurality of bores.

It is the primary object of the present invention to provide a method and apparatus for reducing yarn hairiness in a simple and effective manner. This and other objects of the invention will become clear from an inspection of the detailed description of the drawings, and from the appended claims.

BRIEF DESCRIPTION OF THE DRAWINGS

FIG. 3 is a schematic side cross-sectional view of another form of an exemplary apparatus according to the present invention; and FIG. 4 is a schematic cross-sectional end view of the apparatus of FIG. 3, and shown connected up to a source of fluid under pressure.

DETAILED DESCRIPTION OF THE DRAWINGS

Figure 1:
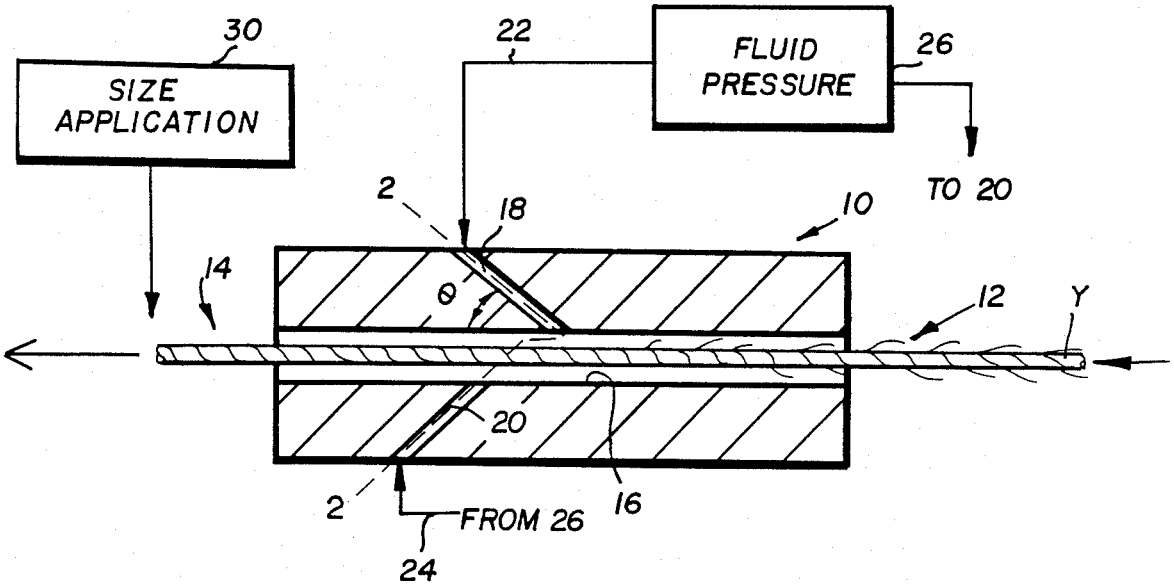
FIG. 1 is a side schematic cross-sectional view of exemplary apparatus according to the present invention.

The exemplary embodiment of the apparatus illustrated in FIG. 1 comprises a tubular body member 10 through which yarn Y having undesired hairiness is adapted to pass. The section 12 of the yarn Y is a section for treatment with the apparatus 10, and, as schematically illustrated in FIG. 1, has excessive hairiness. The yarn section 14 depicts the yarn after treatment with the apparatus 10, and has the protruding hairs thereof twisted and laid down so that it has significantly less hairiness than the section 12.

Figure 2:
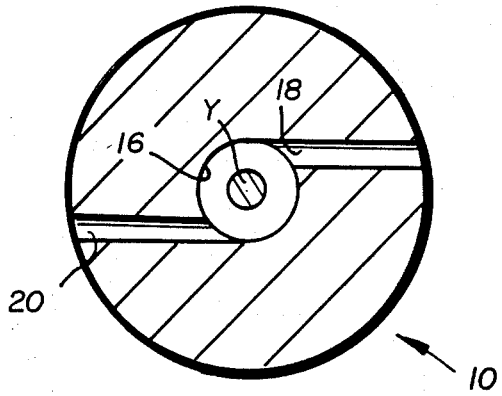
FIG. 2 is an end cross-sectional view of the tubular body member of FIG. 1, taken along lines 2—2 of FIG. 1.

The body 10, typically of brass, hard plastic, ceramic, or the like, has a substantially central, through extending, generally linear passageway 16 formed therein. The passageway 16 is generally circular in cross-section, as can be seen in FIG. 2, and extends from a first end of the body 10 (the end in which the relatively hairy section 12 of yarn Y enters) to a second end (from which the reduced hairiness section 14 exits). The passageway 16 has a substantially constant diameter from the inlet to the outlet.

Means are provided for defining a plurality of bores—in the embodiment illustrated in FIGS. 1 and 2 two bores 18, 20—in the body 10. The bores 18, 20 extend from the external periphery of the body to the central passageway 16, intersecting the central passageway 16 as seen in both FIGS. 1 and 2, and tangentially disposed with respect to the central passageway 16, as can be seen in FIG. 2. The particular diameter of the passageways 18, 20, the number thereof, the particular angle $\theta$ at which they are disposed, etc., may be varied depending upon the particular circumstances.

In the embodiment illustrated in FIGS. 1 and 2, the bores 18, 20 each make a positive angle $\theta$ with respect to the yarn Y and the passageway 16. The angle $\theta$ is significantly greater than 0°, and significantly less than 90°, and preferably is about 40°–50° (an approximately 45° angle being illustrated in FIG. 1). For the FIGS. 1 and 2 embodiment, each of the bores 18, 20 is disposed so that the portion thereof intersecting the passageway 16 is closer to the first end of the body 10 (the yarn introduction end) than is the portion of the bore at the periphery of the body 10.

Fluid under pressure, such as air or steam, is applied to the bores 18, 20 through the conduit 24, 22, respectively, the conduits 22, 24 being connected up to a source of fluid under pressure 26. In the embodiment of FIGS. 1 and 2, note that the points of intersection of the bores 18, 20 with the passageway 16 are spaced from each other along the length of the passageway 16. This spacing can be varied preferably from 0 to 1 times the diameter of the passage 16 depending on the circumstances.

The fluid introduced under pressure into the bores 18, 20 has a swirling or vortex action in the passageway 16, and directly acts on the yarn Y at the area of intersection of each of the bores 18, 20 with the passageway 16. This vortex action causes the protruding hairs of the yarn Y to be twisted, and laid down on the yarn Y, significantly reducing the hairiness, as comparison of sections 12 and 14 of the yarn Y will make clear.

As shown in FIGS. 1 and 2, bores 18 and 20 create a counterclockwise vortex. It is apparent that a clockwise vortex jet can be produced by changing the tangential positions of bores 18 and 20. Generally a Z-twist yarn should be subjected to a Z-vortex jet of the invention, and an S-twist yarn to an S-vortex yet, for most effective laydown of the protruding hairs.

The apparatus 10 is preferably used in conjunction with a size applying device 30, which is disposed essentially immediately after the body 10. The size applied by the apparatus 30 to the yarn Y maintains the protruding hairs in their laid-down position during subsequent processing of the yarn. The fiber laydown benefits of the invention may be secured in conjunction with any type of sizing system such as conventional aqueous sizing; however, it is preferred that the size application apparatus 30 be a hot melt size application apparatus, such as shown in U.S. Reissue patent 29,287, or copending U.S. Pat. application Ser. No. 430,004 filed Sept. 30, 1982, now U.S. Pat. No. 4,540,610. A plurality of adjacent body members 10 can be provided immediately prior to the apparatus 30, each acting on an individual yarn Y.

As depicted in FIGS. 1 and 2, the flow of fluid in passageway 16 is opposite to that of yarn Y, which opposite direction is generally preferred over cocurrent flow, as in FIG. 3, through flow in either direction works to reduce yarn hairiness.

Utilizing an apparatus comparable to that shown in FIGS. 1 and 2, a package of ring-spun yarn (yarn size 26's, 65 percent polyester and 35 percent cotton) was subject to vortex action under a variety of different conditions of pressure, angles $\theta$, and other variables. Yarn hairiness reduction was detected by a Toray fray counter (model No. DT-104) with a setting of 2.5, and a counting time of 10 seconds, the counter being positioned approximately 6 inches away from the yarn outlet of the body 10. A control condition was established with yarn travelling through the apparatus when the fluid pressure source 26 was not supplying air to the system. Yarn hairiness reduction of up to 72% was achieved at yarn speeds of 300–500 ypm by the vortex action, with the vortex pressure of about 5 psig, and an air flow of about 5–10 cubic feet per hour, being adequate to achieve the desired results.

Similar benefits may be achieved with hairy yarns made not only be ring spinning, but also by open-end rotor, air jet, friction, and other spinning methods. Various blends of fibers which lead to problems of yarn hairiness may also be employed. It is understood that with other fibers, blends, and yarn counts, other vortex pressures and yarn speeds must be used to optimize the results. Conventional textile equipment permitting speeds in excess of 1,000 yds per minute and vortex pressures of up to 100 psig can be used.

The embodiment of the apparatus illustrated in FIGS. 3 and 4 has a number of differences from that illustrated in FIGS. 1 and 2. The body 40 has a central passageway which includes a first section 46 adjacent the first end (yarn inlet end) of the body 40, and a second section 47 adjacent the second end (yarn outlet end) of the body 40. In this embodiment rather than a single substantially constant diameter passageway 16, the passageway section 46 has a smaller diameter than the passageway section 47. The passageway section 46 extends approximately to the area where the bores 48, 49, 50 and 51 intersect the passageway, the bores intersecting the passageway at the section 47. Note that in this embodiment four bores 48–51 are provided, spaced substantially equally around the periphery of the passageway section 47. Fluid pressure is provided from source 56, and at the outer periphery of the body 40 adjacent each bore a cutout 57 may be provided to facilitate connection of a conduit to the body 40. Note also that in this embodiment the direction of slant of the bores (see bore 48 in FIG. 3) is different than in the FIGS. 1 and 2 embodiment. In this embodiment, the portion of the bore 48 where it intersects the passageway section 47 is closer to the second end (the yarn outlet end) of the body 40 than is the portion of the bore 48 at the outer periphery of the body 40.

The internal geometry of passages 16, 47, 48 need not be cylindrical as depicted; for instance, it may assume a slight taper of between about 0°–10°.

While the invention has herein been described in terms of a single jet acting on a single threadline, it is to be understood that normally there will be a multiplicity of threadlines, passing through a like number of jets manifolded in such a way as to be fed from a common source of fluid, such as compressed air.

It will thus be seen that according to the present invention a method and apparatus have been provided for reducing the yarn hairiness in a simple and effective manner. While the invention has been herein shown and described in what is presently conceived to be the most practical and preferred embodiments thereof, it will be apparent to those of ordinary skill in the art that many modifications may be made thereof within the scope of the invention, which scope is to be afforded the broadest interpretation of the appended claims so as to encompass all equivalent structures and methods.

We claim:

1. A method of reducing hairiness in preexisting spun yarn having a Z-twist comprising the steps of:

(a) passing the yarn, in substantially dry condition, in a generally linear path; and (b) while said substantially dry preexisting spun yarn having a Z-twist is passing in said generally linear path, directing a plurality of streams of fluid under approximately 5 psig pressure and with a flow rate of approximately 5–10 cubic feet per hour towards the path so as to establish a Z-vortex action acting on said yarn which twists and lays down protruding hairs causing the undesired yarn hairiness, so that undesired yarn hairiness is substantially eliminated.

2. A method as recited in claim 1 comprising the further step (c), immediately after step (b) of applying size to the yarn to maintain protruding hairs that have been laid down in the laid down position.

3. A method as recited in claim 1 comprising the further step (c), immediately after step (b) of applying hot melt size to the yarn to maintain protruding hairs that have been laid down in the laid down position.

4. A method as recited in claim 1 wherein step (b) is practiced utilizing a body having a substantially cylindrical through-extending linear passageway generally circular in cross-section with an inlet at a first end thereof, and an outlet at a second end thereof; and means for defining a plurality of fluid conducting bores each extending from the outer periphery of the body to the central passageway intersecting and tangentially disposed with respect to the linear passageway; and by introducing fluid under pressure to the bores so that it acts directly upon the yarn passing through the passageway where each bore intersects the passageway.

5. A method as recited in claim 4 wherein the introduced fluid is selected from the group consisting essentially of steam and air.

6. A method as recited in claim 1 wherein the yarn treated in steps (a) and (b) is ring spun yarn.

7. A method of reducing hairiness in preexisting spun yarn having an S-twist comprising the steps of:

(a) passing the yarn, in substantially dry condition, in a generally linear path; and (b) while said substantially dry preexisting spun yarn having an S-twist is passing in said generally linear path, directing a plurality of streams of fluid under approximately 5 psiq pressure and with a flow rate of approximately 5–10 cubic feet per hour towards the path so as to establish a S-vortex action acting on said yarn which twists and lays down protruding hairs causing the undesired yarn hairiness, so that undesired yarn hairiness is substantially eliminated.

8. A method as recited in claim 7 comprising the further step (c), immediately after step (b) of applying size to the yarn to maintain protruding hairs that have been laid down in the laid down position.

9. A method as recited in claim 7 comprising the further step (c), immediately after step (b) of applying hot melt size to the yarn to maintain protruding hairs that have been laid down in the laid down position.

10. A method as recited in claim 7 wherein step (b) is practiced utilizing a body having a substantially cylindrical through-extending linear passageway generally circular in cross-section with an inlet at a first end thereof, and an outlet at a second end thereof; and means for defining a plurality of fluid conducting bores each extending from the outer periphery of the body to the linear passageway intersecting and tangentially disposed with respect to the linear passageway; and by introducing fluid under pressure to the bores so that it acts directly upon the yarn passing through the passageway where each bore intersects the passageway.

11. A method as recited in claim 10 wherein the introduced fluid is selected from the group consisting essentially of steam and air.

12. A method as recited in claim 7 wherein the yarn treated in steps (a) and (b) is ring spun yarn.

* * * * *